US005188153A

United States Patent [19]

Farley

[11] Patent Number: 5,188,153

[45] Date of Patent: Feb. 23, 1993

[54] FILL YARN INSERTION AND BEATUP USING INFLATABLE MEMBRANE

[75] Inventor: Gary L. Farley, Yorktown, Va.

[73] Assignee: The United States of America as represented by the Administration of the National Aeronautics and Space Administration, Washington, D.C.

[21] Appl. No.: 766,597

[22] Filed: Sep. 26, 1991

[51] Int. Cl.[5] ..... D03D 47/14

[52] U.S. Cl. ..... 139/11; 139/DIG. 1; 139/429; 139/436

[58] Field of Search ..... 139/11, 429, 443, 456, 139/196.1, 436, 429, DIG. 1

[56] References Cited

U.S. PATENT DOCUMENTS 3,881,523 5/1975 Paton et al. ..... 139/456 X 4,143,685 3/1979 Temple et al. .

*Primary Examiner*—Andrew M. Falik

*Attorney, Agent, or Firm*—Kevin B. Osborne

[57] ABSTRACT

An apparatus and method for integral fill yarn insertion and beatup is provided. A modified rapier contains a channel for holding fill yarn. The channel is covered with a flexible and inflatable boot, and an inflating apparatus for this boot is also attached. Fill yarn is inserted into the channel, and the rapier is extended into a shed formed by warp yarn. Next, the rapier is pushed into the fell of the fabric, and the flexible and inflatable cover inflated, which both pushes the yarn into the fell of the fabric and performs beatup. The rapier is withdrawn and the shed closed to complete one step of the weaving process.

17 Claims, 6 Drawing Sheets

FILL YARN INSERTION AND BEATUP USING INFLATABLE MEMBRANE

ORIGIN OF THE INVENTION

The invention described herein was made by an employee of the United States Government and may be manufactured and used by or for the Government for governmental purposes without the payment of any royalties thereon of therefor.

CROSS-REFERENCE

The present application relates to concurrently filed application Ser. No. 07/766,609, filed Sep. 6, 1991, NASA Case No. LAR 14048-1, entitled "Woven Angle Ply Fabric and Apparatus and Method for Producing such Fabrics", the specification of which is hereby incorporated by reference.

BACKGROUND OF THE INVENTION

1. Field of the Invention

The present invention relates to method for inserting fill yarns and performing yarn beatup, and more particularly to a method for performing those two tasks as a single process, thus eliminating the use of the reed beatup method.

2. Description of the Prior Art

There are numerous methods of fill yarn insertion that range from the simple shuttles used in the eighteenth century to modern water jets. However, the method of fill yarn beatup has changed little in this same time period. A reed is still extensively used to beatup the fill yarns in a fabric.

In conventional weaving of fabrics, yarns are oriented in orthogonal warp and welt, or fill, directions. The warp direction is along the length of the fabric and the fill direction is transverse to the length of the fabric. The process of inserting the fill yarn includes forming a shed the warp yarns, pulling a fill yarn across the warp yarns in the shed, closing the shed, and a "beatup" of the fill yarns into the fell of the fabric with the reed. This process is essentially the same regardless of the degree of automation incorporated in the loom. However, the conventional reed used to beatup the fill yarn in a fabric cannot be utilized in structural performs that have yarns oriented along the bias of the fabric because the elements of the reed would hit the bias warp yarn.

SUMMARY OF THE INVENTION

An object of the present invention is to provide a method and apparatus for integral fill yarn insertion and beatup.

Another object of the present invention is to provide a method of fill yarn insertion and beatup that can be utilized in producing structural preforms that have yarns oriented along the bias of the fabrics.

Other objects and advantages of this invention will become apparent hereinafter in the specification and drawings which follow.

According to the present invention, the forgoing and additional objects are attained by providing an apparatus in accordance with a preferred embodiment of the invention which generally comprises: a rapier with a means for holding yarn; a flexible and inflatable means for covering the means for holding yarn; and a means for inflating the flexible and inflatable means. The apparatus is used in the integral insertion and beatup process. In one embodiment of the invention, the rapier contains a channel with a flexible and inflatable cover or boot. Fill yarn is inserted into the channel and the rapier is extended into a shed in the warp yarns. Actuators then push the rapier into the fell of the fabric. At this point, the cover over the channel is inflated to both insert the yarn into the fell and perform beatup. Finally, the rapier is withdrawn, the shed closed, and the process repeated as desired.

DESCRIPTION OF THE PREFERRED EMBODIMENT

Figure 1:
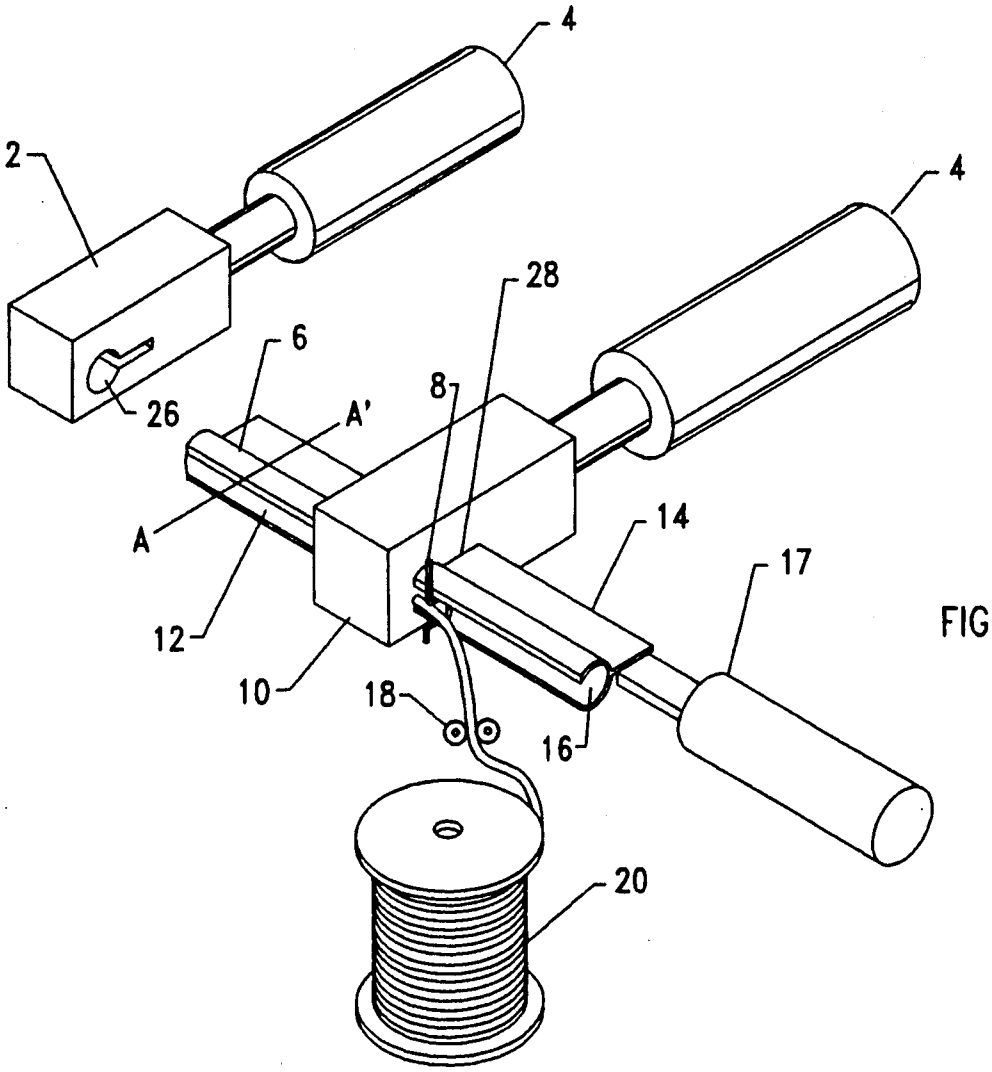
FIG. 1 is a pictorial view of the apparatus according to the present invention.
Figure 5:
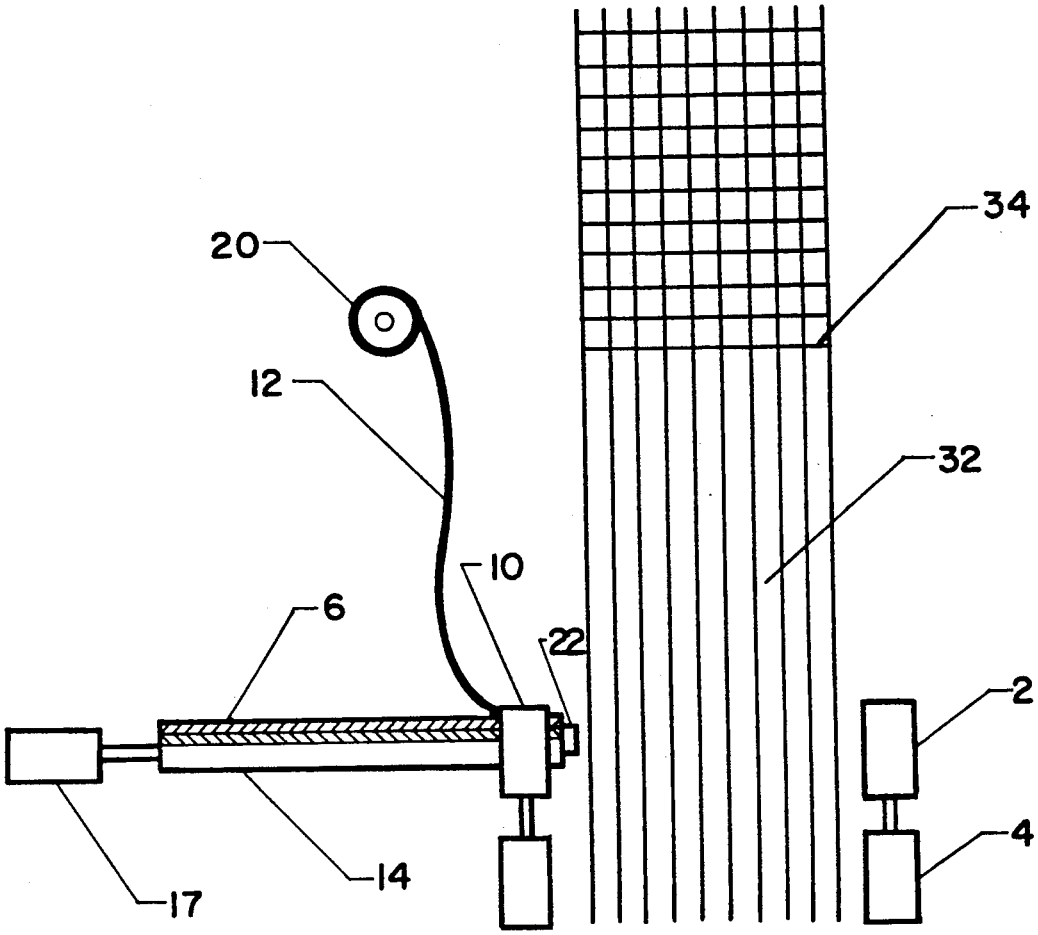
FIG. 5 is a top view of the apparatus with the rapier removed from the warp yarns.

Referring now to the drawings, and more particularly to FIG. 1, a pictorial view of the apparatus of the present invention is shown. In the illustrated embodiment, a rapier 14, defining a fill yarn channel 16 which is covered with flexible and inflatable boot 6 and holds fill yarn 12, is placed so as to be able to slide freely in a transverse direction between rapier insert mechanism 10 and rapier receiver 2 by passing through rapier insert channel 28 into rapier receiving channel 26. In order to allow transverse movement of rapier 14 through rapier insert channel 28 and rapier receiver 2, rapier 14 is attached to an actuator 17 which can be hydraulic, pneumatic or electromechanical. Rapier 14 is used throughout the present application to refer to the long bar that extends across warp yarns 32 to insert fill yarn 12, as shown in FIG. 5. In order to allow longitudinal movement of rapier 14, rapier insert mechanism 10 and rapier receiver 2 are attached to respective actuators 4, which can be hydraulic, pneumatic, or electromechanical.

Figure 2:
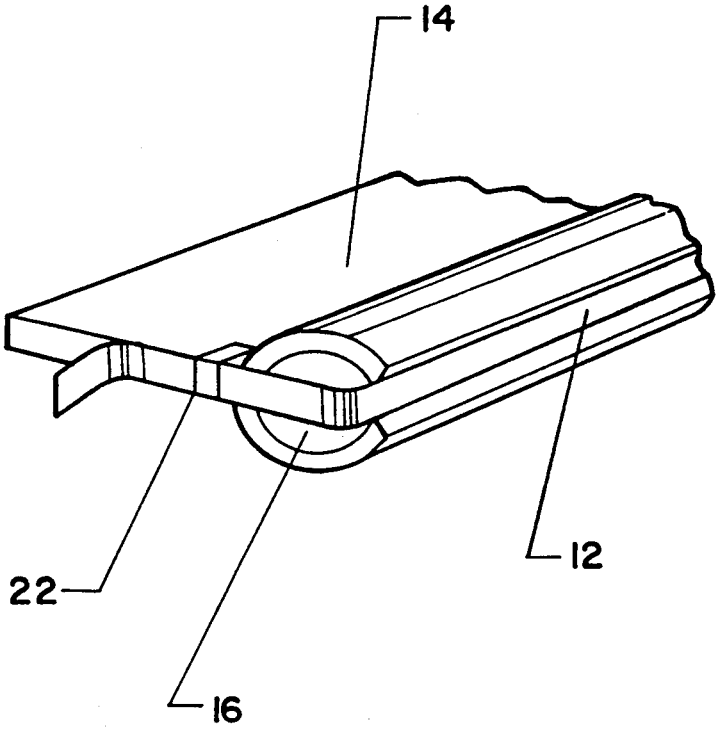
FIG. 2 is a pictorial view of the edge of the rapier of FIG. 1.

Referring now to FIG. 2, a pictorial view of the edge of rapier 14 is shown. As rapier 14 is moved by actuator 17 in a transverse direction toward rapier receiver 2 (FIG. 1), fill yarn clip 22, or another mechanism of similar function, holds the end of fill yarn 12 as rapier 14 is being extended and while fill yarn 12 is being inserted into fill yarn channel 16.

Figure 3:
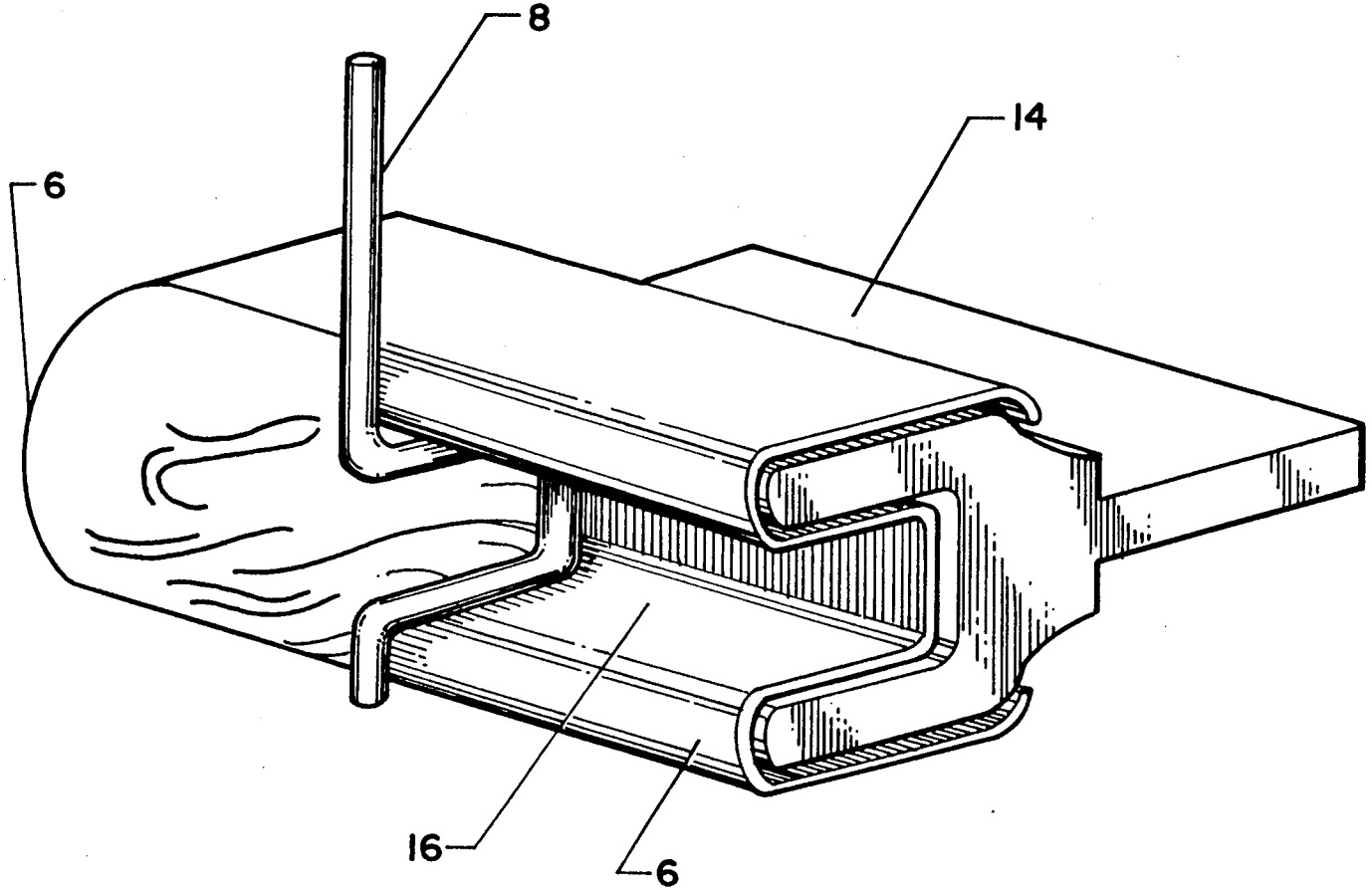
FIG. 3 is a pictorial view of the rapier and boot guide of FIG. 1.

Referring now to FIG. 3, a pictorial view of rapier 14 and boot guide 8 is shown. As rapier 14 moves in a transverse direction away from rapier receiver 2 (FIG. 1), boot guide 8 shapes and guide flexible and inflatable boot 6 back into fill yarn channel 16.

Figure 4A:
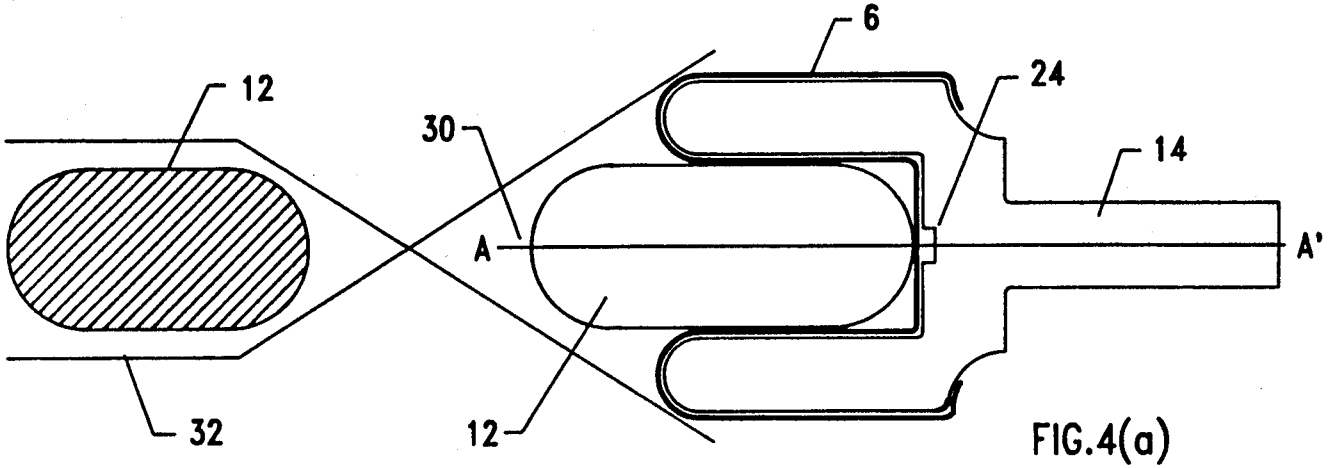
FIGS. 4(*a*) and (*b*) are cross-sectional views along line A—A' of FIG. 1 of the rapier.
Figure 4B:
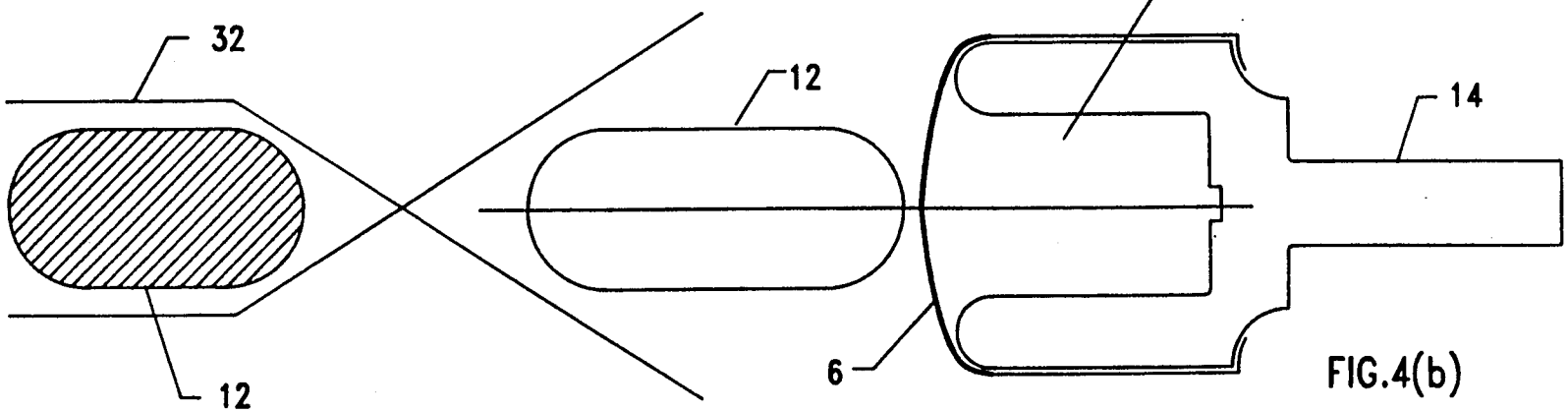

Referring now to FIGS. 4(*a*) and (*b*), a cross-section along line A—A' of FIG. 1 of rapier 14 is pictured. These figures demonstrate how fill yarn 12 is pushed out of fill yarn channel 16 and into shed 30 by the inflation of flexible and inflatable boot 6 through air inflating slot 24 connected to a conventional air supply (not shown).

Figure 6:
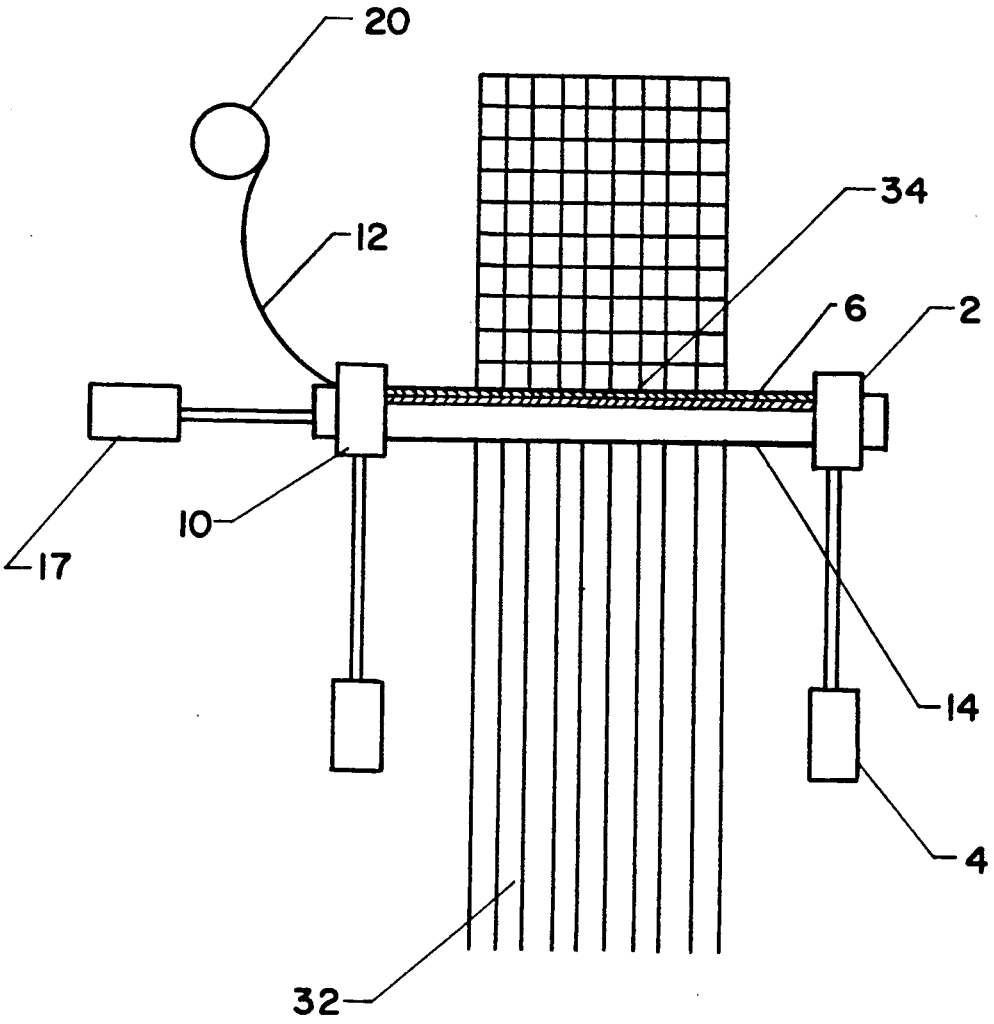
FIG. 6 is an overview of the apparatus with the rapier at the fell of the fabric.

Referring now to FIGS. 5 and 6, top views of the apparatus are shown. In FIG. 5, the apparatus is shown withdrawn from warp yarns 32. In FIG. 6, the apparatus is in position to deliver fill yarn 12 into fell 34. In order to perform integral fill yarn insertion and beatup, certain steps must be followed. First, fill yarn 12 is inserted into fill yarn clip 22 (FIGS. 2 and 5) while rapier 14 is completely removed from longitudinal warp yarns 32. A shed is then formed with warp yarns 32. Rapier 14 is extended transversely by actuator 17 through rapier insert channel 28 and the shed of warp yarns 32 until it reaches rapier receiving channel 26 in rapier receiver 2. As the rapier 14 passes through rapier insert channel 28, fill yarn 12 is inserted in fill yarn channel 16 (FIG. 1). Tensile forces are exerted on fill yarn 12 by way of tension rollers 1 during the insertion process to ensure that fill yarn 12 is straight. After rapier 14 has been received by rapier receiver 2, actuators 4 are energized and rapier 14 is pushed into fell 34 of the fabric (FIG. 4(*a*), 4(*b*) and 6). Next, fill yarn 12 is cut at a point between warp yarns 32 and rapier insert mechanism 10 and at a point between warp yarns 32 and the rapier receiver 2. The flexible and inflatable boot 6 is inflated through air inflation slot 24, releasing yarn 12 from clip 22 and pushing fill yarn 12 out of fill yarn channel 16 and into shed 30, accomplishing both insertion of fill yarn into the fabric and beatup. Actuators 4 are de-energized and longitudinally reversed, removing rapier 14 from fell 34. Rapier 14 is transversely retracted from warp yarns 32 by actuator 17 and shed 30 is closed. Boot 6 is deflated at some point after insertion of the yarn and beatup and prior to the next weave sequence, and preferably is deflated substantially concurrently with the retraction of the rapier 14. As actuator 17 causes rapier 14 to pass through rapier insert channel 28, boot guide 8 pushes flexible and inflatable boot 6 back into fill yarn channel 16 (FIG. 3). This fill yarn insertion and beatup process is repeated until all of the fill yarns are inserted and the fabric is advanced.

Many modifications, improvements and substitutions will be apparent to the skilled artisan without departing from the spirit and scope of the present invention as described herein and defined in the following claims.

What is claimed is:

1. An apparatus for inserting fill yarns and performing yarn beatup as a single process, comprising:

(a) a rapier with means for holding a strand of yarn;

(b) a flexible and inflatable means to cover the means for holding a strand of yarn; and (c) means for inflating the flexible and inflatable means.

2. The apparatus of claim 1, further comprising means for affixing and releasing the yarn to and from the holding means of said rapier.

3. The apparatus of claim 2, wherein the means for affixing and releasing the yarn is a fill yarn clip.

4. The apparatus of claim 1, further comprising a means for guiding yarn into means for holding a strand of yarn.

5. The apparatus of claim 4, further comprising a fill yarn clip.

6. The apparatus of claim 1, wherein the means for holding a strand of yarn is a U-shaped channel defined in the rapier.

7. The apparatus of claim 6, further comprising a means for guiding yarn into the U-shaped channel.

8. The apparatus of claim 7, wherein the means for guiding yarn consists of a guide having a U-shape conforming to the interior of the U-shaped channel of the rapier.

9. The apparatus of claim 7, further comprising a fill yarn clip.

10. The apparatus according to claim 1, further comprising means for translating said rapier relative to a fabric.

11. The apparatus according to claim 1, wherein said rapier further comprises a means for conforming said flexible and inflatable cover means to said means for holding a strand of yarn.

12. The apparatus according to claim 1, further comprising means for feeding the strand of yarn to said means for holding a strand of yarn.

13. A method of inserting fill yarns and performing fill yarn beatup comprising the steps of:

(a) forming a shed from warp yarns;

(b) inserting yarn in a means for holding a strand of yarn on a rapier as the rapier is extended to center across the shed;

(c) cutting the yarn at the edges of the warp yarns;

(d) pushing the rapier into the fell of the fabric;

(e) pushing the yarn out the means for holding a strand of yarn by inflating a flexible and inflatable means covering the means for holding a strand of yarn;

(f) pulling back the rapier, leaving the yarn in the fell of the fabric;

(g) retracting the rapier from the shed; and (h) closing the shed.

14. The method of claim 13, wherein the yarn is held straight with tensile forces while it is inserted into the means for holding a strand of yarn.

15. The method of claim 13, wherein hydraulic, pneumatic, or electromechanical actuators are used to push the rapier into the fell of the fabric and pull it away from the fell.

16. The method of claim 13, further comprising deflating the flexible and inflatable cover means.

17. The method of claim 16, wherein said deflating step occurs substantially concurrently with said step of retracting the rapier from the shed.

* * * * *